US008549786B1

(12) United States Patent
Griffith

(10) Patent No.: US 8,549,786 B1
(45) Date of Patent: Oct. 8, 2013

(54) RIFLE REST

(76) Inventor: Todd Griffith, Corsica, PA (US)

( * ) Notice: Subject to any disclaimer, the term of this patent is extended or adjusted under 35 U.S.C. 154(b) by 0 days.

(21) Appl. No.: 13/151,221

(22) Filed: Jun. 1, 2011

Related U.S. Application Data

(60) Provisional application No. 61/424,406, filed on Dec. 17, 2010.

(51) Int. Cl.
*F41A 23/14* (2006.01)

(52) U.S. Cl.
USPC ..... 42/94

(58) Field of Classification Search
USPC ..... 42/90, 94, 72; 89/37.04
See application file for complete search history.

(56) References Cited

U.S. PATENT DOCUMENTS

| | | | | |
|---|---|---|---|---|
| 2,870,683 | A | 1/1959 | Wilson | |
| 3,016,802 | A | 1/1962 | Grunenberg | |
| 3,608,852 | A * | 9/1971 | Horn | 248/166 |
| 4,266,748 | A | 5/1981 | Dalton | |
| 4,492,050 | A | 1/1985 | Kagehiro | |
| 4,506,466 | A * | 3/1985 | Hall | 42/94 |
| 4,575,964 | A | 3/1986 | Griffin | |
| 4,876,814 | A | 10/1989 | Lombardo | |
| 4,967,497 | A | 11/1990 | Yakscoe | |
| 5,081,782 | A | 1/1992 | Wright | |
| 5,347,740 | A | 9/1994 | Rather et al. | |
| 5,913,667 | A | 6/1999 | Smilee | |
| 5,913,668 | A * | 6/1999 | Messer | 42/94 |
| 6,044,747 | A | 4/2000 | Felts | |
| 6,272,785 | B1 * | 8/2001 | Mika et al. | 42/94 |
| 6,574,899 | B1 * | 6/2003 | Mostello | 42/94 |
| 7,210,391 | B2 | 5/2007 | Beckmann | |
| 7,313,884 | B2 | 1/2008 | Eddins | |
| 7,571,563 | B2 | 8/2009 | Peterson | |
| 7,823,318 | B2 | 11/2010 | Hall | |
| 2007/0074439 | A2 | 4/2007 | Cauley et al. | |
| 2009/0119967 | A1 * | 5/2009 | Hall | 42/1.06 |
| 2010/0122482 | A1 | 5/2010 | Simms et al. | |
| 2010/0236125 | A1 | 9/2010 | Morrow et al. | |

OTHER PUBLICATIONS

Allen Recoil Reducer Shooting Rest and Gun Vise, http://www.sportsmansguide.com/net/cb/allen-recoil-reducer-shooting-rest-and-gun-vise.aspx?a=691318.

Shooters Ridge Rock Steady Zero Kick Rifle Shooting Rest, http://www.exploreproducts.com/shooters-ridge-rock-steady-zero-kick-riflerest.htm?utm_source=VersaFeed&utm_medium=Ver.

Shooters Ridge Deluxe Rifle Rest With Shot Bag Tray, http://www.amazon.com/Shooters-Ridge-Deluxe-Rifle-Rest/dp/B000NDQFIA.

Cabela's Fall 2011 Catalog p. 236.

Stoney Point Tripod with Rear Support, shown on the Cabelas website, http://www.cabelas.com/product/Hunting/Hunting-Accessories/Shooting-Sticks-Bipods|/pc/104791680/c/10473498.

Cabelas Shooting 2011 catalog pp. 36-43.

* cited by examiner

*Primary Examiner* — Stephen M Johnson
*Assistant Examiner* — John D Cooper
(74) *Attorney, Agent, or Firm* — William F. Lang, IV; Lang Patent Law LLC

(57) ABSTRACT

A rifle rest is structured to be utilized in conjunction with standard, readily available tripods, for example, camera tripods. Some examples of the rifle rest include a rear stock support that is secured to two of the three tripod legs at its lower portion, and to the shoulder stock of the rifle at its upper portion. Other embodiments of the rifle rest include an elastomeric recoil reducer secured between the tripod and the shoulder stock.

20 Claims, 8 Drawing Sheets

RIFLE REST

CROSS REFERENCE TO RELATED APPLICATION

This application claims the benefit of U.S. provisional patent application Ser. No. 61/424,406, filed Dec. 17, 2010, and entitled "Rifle Rest."

TECHNICAL FIELD

The present invention relates to shooting rests. More specifically, a rifle rest that works in conjunction with commonly available tripods, for example, those utilized with cameras, is provided.

BACKGROUND INFORMATION

The stability with which a rifle is held is critical to the accuracy with which it can be fired. Conversely, the ease of transporting a rifle and ancillary equipment, as well as the speed with which it can be brought to bear, can be critical to success during hunting. Efforts to balance these considerations have been made throughout the history of shooting.

At one extreme, various unsupported shooting positions have been developed, most of which are designed to rely on bone support rather than muscle support for the rifle, thereby minimizing fatigue and movement of the rifle. Many of these positions utilize a sling to reduce strain on the bicep of the support arm, thereby further stabilizing the shooting position. Although a shooter utilizing unsupported positions has little more than the rifle to transport, and can assume a shooting position quickly, there are definite limits to the stability with which a rifle may be held, even when utilizing a sling to stabilize the support arm.

At the opposite extreme, rifle rests for use at commercial shooting ranges are available which not only completely support the rifle, but which also minimize felt recoil. These rifle rests would be unworkable in a hunting situation, because they are intended to be utilized with the shooting benches typically found at rifle ranges. Furthermore, they typically rely on weight to reduce felt recoil, making their transportation during hunting impractical. An example of this is the LEAD SLED available from Caldwell Shooting Supplies.

In between these two extremes, various monopod, bipod, and tripod rifle rests have been developed. One tripod, marketed by Stoney Point, includes a rear stock support that attaches to one of the tripods three legs, supporting the shoulder stock of the rifle in a rubber covered V-shaped support. The rifle's fore end is supported by a similar rubber covered V-shaped support sitting on top of the tripod. The rear stock support is held in place solely by friction and a set screw. According to user feedback found on one website where this tripod is marketed, this arrangement cannot be depended upon to safely support the weight of a rifle without the assistance of the shooter. Furthermore, the device utilizes a shooting specific tripod. A shooter who wishes to carry both a camera and a rifle in the field, utilizing a tripod to support both, must therefore carry two tripods.

Other devices have attempted to utilize a camera tripod to support a rifle. For example, U.S. Pat. No. 6,574,899, discloses a tripod mounted combined gun rest and armrest. The gun rest 10 includes an armrest or platform 12 adapted to be mounted on a tripod 14. The platform 12 includes a forward gun cradle 16 and rear gun cradle 18, each of which is mounted in an adjustment slot disposed within the platform 12. The tripod 14 is a conventional photographic tripod. The forward gun cradle 16 and rear gun cradle 18 can be adjusted so that the center of gravity of the gun is centered over the tripod 14. A hunter utilizing this device would therefore be required to carry substantial extra hardware in addition to the camera tripod while in the field.

U.S. Pat. No. 6,272,785 discloses a gun support device. The gun support assembly 10 includes a gun support device 14 includes a body 30 that defines a channel 42 therein, with the channel 42 being structured to resist lateral motion of the gun. The gun support device 14 is structured to be mounted on a tripod 20, which may be a conventional tripod that is typically used in photography.

U.S. Pat. No. 5,347,740 discloses a combination camera mount and gun mount. The gun mount includes mounting units 7 for holding a rifle, attached at either end of the mounting beam 9. The mounting beam 9 is pivotally attached to a cylindrical post 2, which is held in place by the mounting unit 25 (FIG. 7). A camera mount 21 may be attached to the mounting beam 9.

U.S. Pat. No. 5,913,668 discloses a weapon rest having a base 12 in the form of a tripod supporting a shaft 11. A cradle 13 is pivotally secured to the top of the shaft 11. A swivel head 20 at the top of the shaft 11 permits horizontal rotation of the cradle 13, while the pivot pin 21 permits vertical rotation of the cradle 13. A spring 15 is connected between the shaft 11 and cradle 13 to provide tension, which is claimed to enhance accuracy.

U.S. Pat. No. 7,313,884 discloses a recoil suppressing gun support. The gun support 12 includes a base member 18 that is structured to mount on the windowsill 16 of a hunting shelter. A barrel support 32 is mounted on one end of the base 18. A cradle 24 is mounted on the opposite end of the base 18. A mounting plate 44 is attached to the bottom surface of the base 18 by a bolt 46, in a manner that permits rotation of the base 18 relative to the mounting plate 44.

U.S. Pat. No. 7,823,318 discloses a rifle recoil absorption system. The recoil absorption system includes a harness 15 having a large loop 17 of webbing material extending along both sides of the four stock 25 and stock 27 of the rifle, wrapping around the butt 29. Smaller loops 13, 19 extending around the shoulder stock 27 and fore stock 25, respectively, hold the loop 17 in place. An attachment strap 21 is secured to the loop 19 of the rifle harness. The attachment strap 21 passes underneath a table 31, and attaches to the back end of the table 31 by utilizing a U-shaped clamp 37.

Upon review of the above references, it becomes apparent that those which incorporate a means of recoil reduction are all limited to a static location such as a shooting bench at a shooting range or a hunting shelter. None of the above references which includes a means of recoil reduction is suitable for use with any mobile hunting method. Others include significant additional components which would have to be carried in the hunting fields in order to utilize the rest while hunting. Still others provide only a single point of support for the rifle, making it susceptible to movements by the shooter during shooting.

Accordingly, there is a need for a shooting rest that may be utilized in conjunction with a commonly available tripod such as a camera tripod. There is a further need for a shooting rest that supports the rifle at two points, and may completely support the rifle without the aid of the shooter, while still being light weight and easy to transport in a hunting field. There is an additional need for a shooting rest that combines portability and recoil reduction.

SUMMARY

The above needs are met by a shooting rest having a fore end support that is structured to be mounted on a commonly available tripod, and a shoulder stock support having a lower end that is secured to two of the tripods three legs, and an upper and that is secured to the rifle's shoulder stock.

The above needs are also met by a shooting rest having a fore end support that is structured to be mounted on a commonly available tripod, and an elastomeric recoil reducer secured between the tripod and the rifle.

These and other aspects of the rifle rest will become more apparent through the following description and drawings.

BRIEF DESCRIPTION OF THE DRAWINGS

Like reference characters denote like elements throughout the drawings.

DETAILED DESCRIPTION

Figure 1:
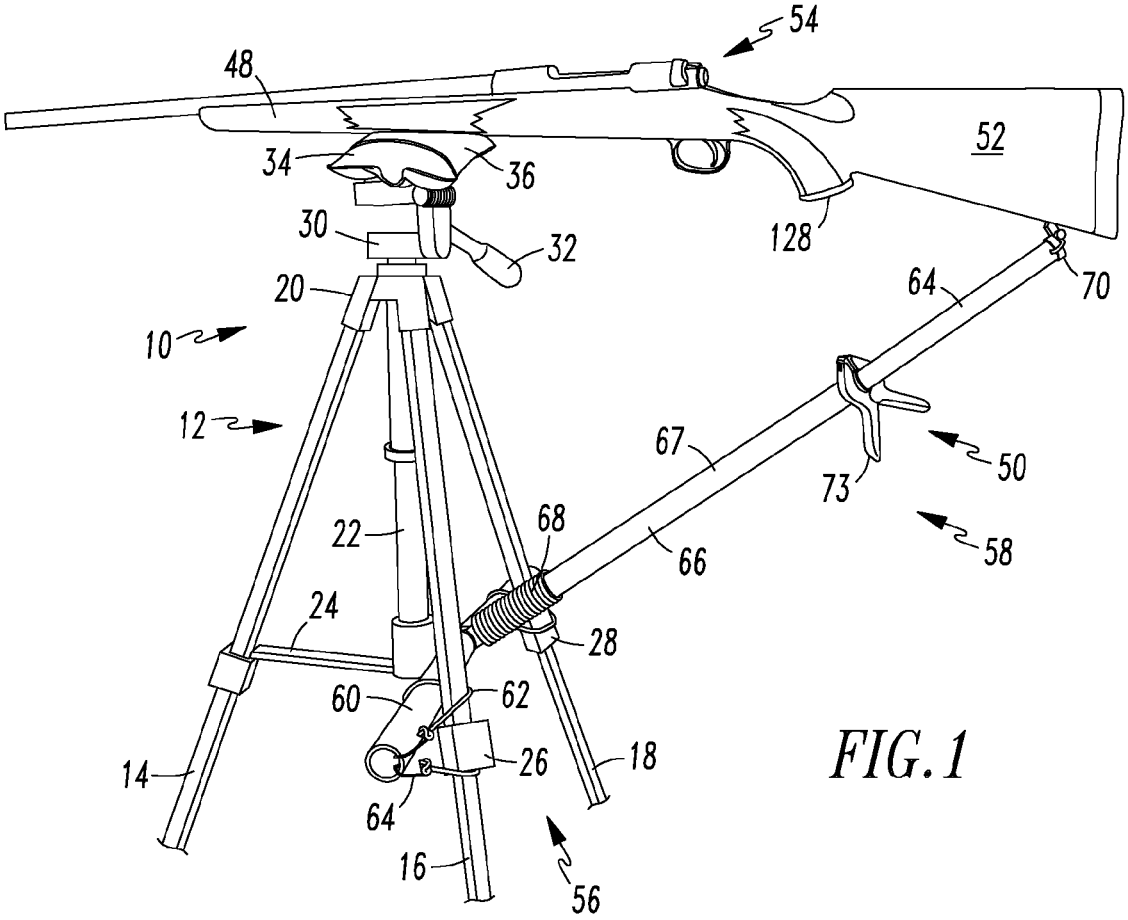
FIG. 1 is an environmental side perspective view of a rifle rest.

Referring to the drawings, various examples of the rifle rest are shown. One example of the rifle rest 10 is shown in FIG. 1, with the individual components shown in FIG. 8. The rifle rest 10 is structured to be utilized in conjunction with standard, readily available tripods, for example, the illustrated camera tripod 12. The tripod 12 includes three legs 14, 16, 18, hingedly connected to a base 20. A central pole 22 is slidably mounted within the base 20. In some examples, the length of the central pole 22 may be adjustable utilizing methods well known to those skilled in the art. A leg brace 24, 26, 28 connect each of the legs 14, 16, 18, respectively, to a bottom portion of the central pole 22. The top of the central pole 22 includes a mount 30 pivotally secured thereto. A handle 32 may be provided for pivoting the mount 30 with respect to the remainder of the tripod 10.

Figure 2:
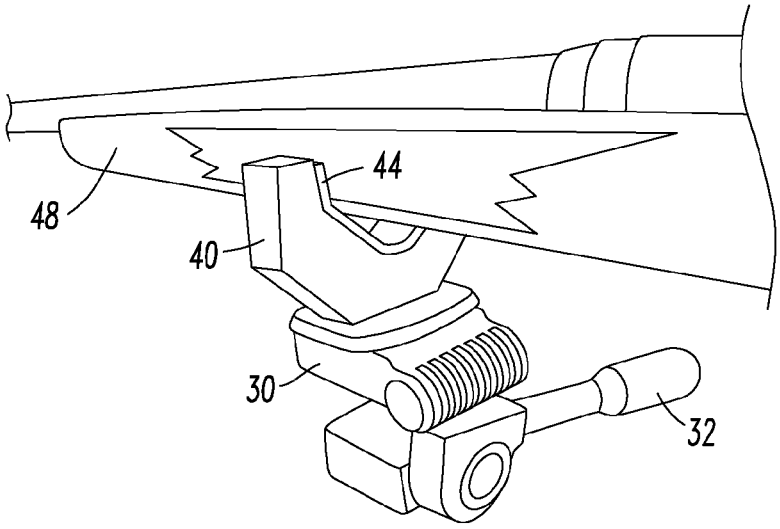
FIG. 2 is an environmental side perspective view of an alternative fore end support for a rifle rest of FIG. 1.
Figure 3:
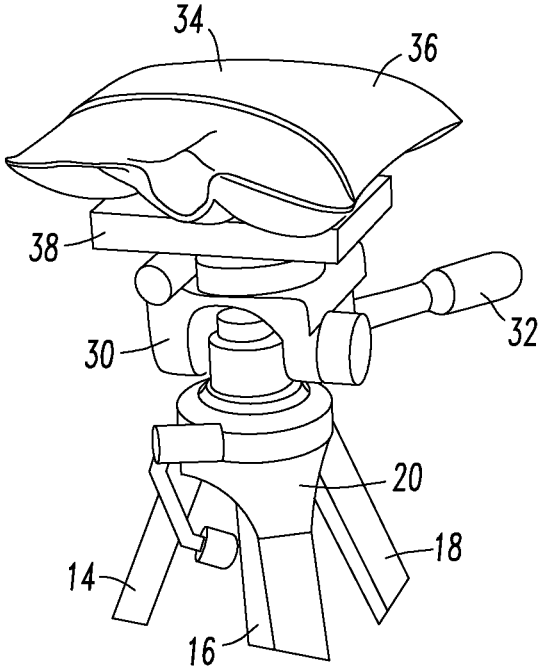
FIG. 3 is a side perspective view of a fore end support for a rifle rest of FIG. 1 mounted on a tripod.

The rifle rest 10 includes a fore end support that is structured to be secured to the mount 30 in the same manner as a camera, for example, by providing a threaded hole that is structured to receive an upwardly extending threaded rod on the top surface of the mount 30. This attachment is a well understood feature of camera tripods, and is therefore not shown in detail. One example of a fore end support 34 is illustrated in FIGS. 1 and 3. The fore end support 34 is a sandbag type support having a sandbag 36 on which to rest a rifle fore end, and a solid base 38 which includes a threaded hole 39 (FIG. 8) for mounting to the mount 30 of the tripod 12. An alternative fore end support 40 is illustrated in FIG. 2. The fore end support 40 includes a generally U-shaped or V shaped cradle 42 that may include a cushioned inner surface 44 to protect the fore end 48 from scratches or other damage. The cradle 42 includes a threaded hole 45 (FIG. 8) defined within its lowermost surface for securing it to the mount 30.

Figure 5:
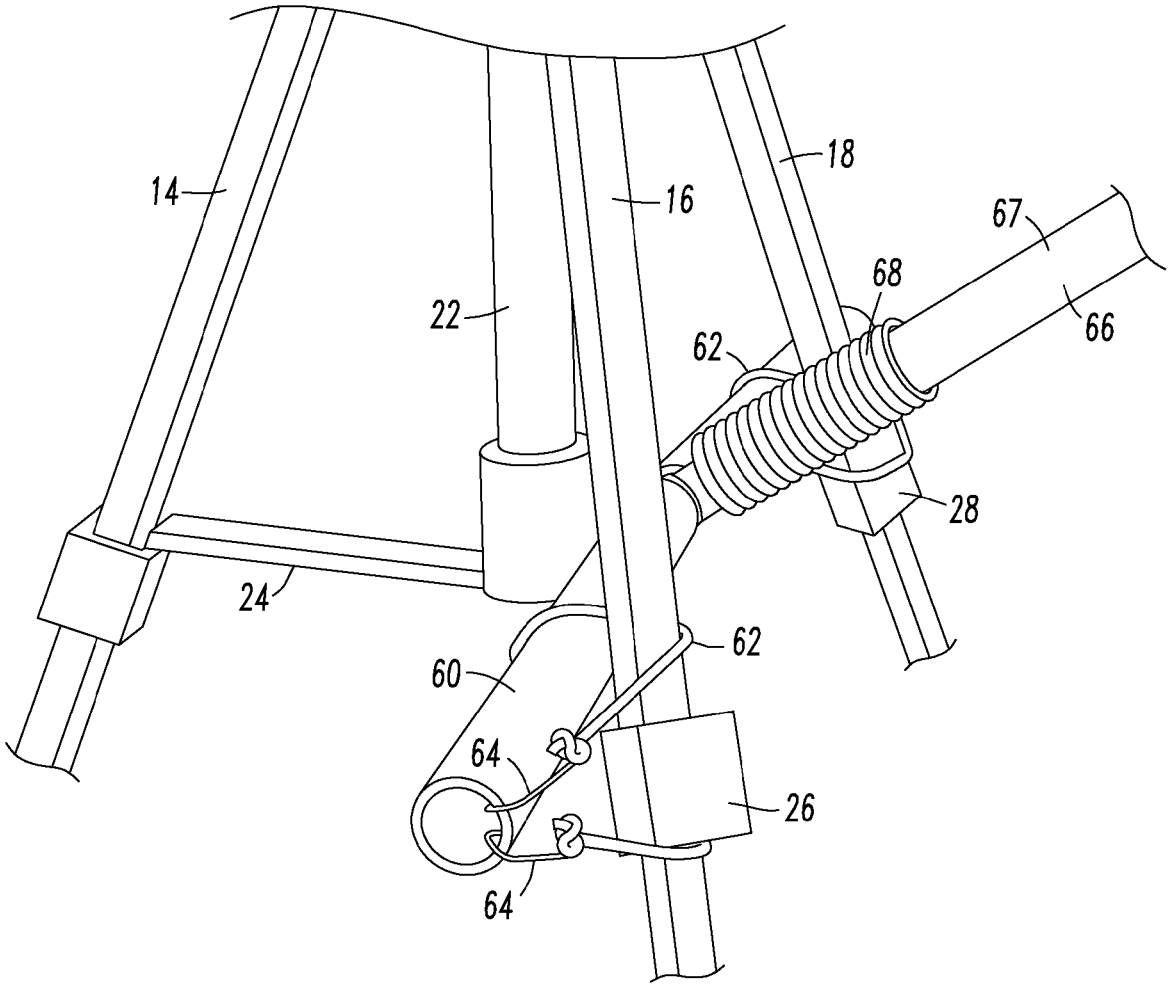
FIG. 5 is a side perspective view of a lower portion of a shoulder stock support for a rifle rest of FIG. 1 being used in conjunction with a tripod.

Referring back to FIG. 1, the rifle rest 10 further includes a shoulder stock support assembly 50 for supporting the shoulder stock 52 of a rifle 54. The shoulder stock support assembly 50 includes a lower portion 56 and an upper portion 58. The lower portion 56 includes a generally horizontal support 60 that is structured to be secured to two of the three tripod legs, which in the illustration are legs 16 and 18. In the illustrated example, the horizontal support 60 is structured to rest on top of the leg braces 26, 28. As shown in FIG. 5, the horizontal support 60 is secured against the legs 16 and 18 by a pair of elastomeric cords 62, each of which has a pair of hooks 64 at each end. Each of the elastomeric cords is passed around the horizontal support 60, and one of the legs 16, 18. The hooks 64 are then secured to the ends of the horizontal support 60.

Figure 14:
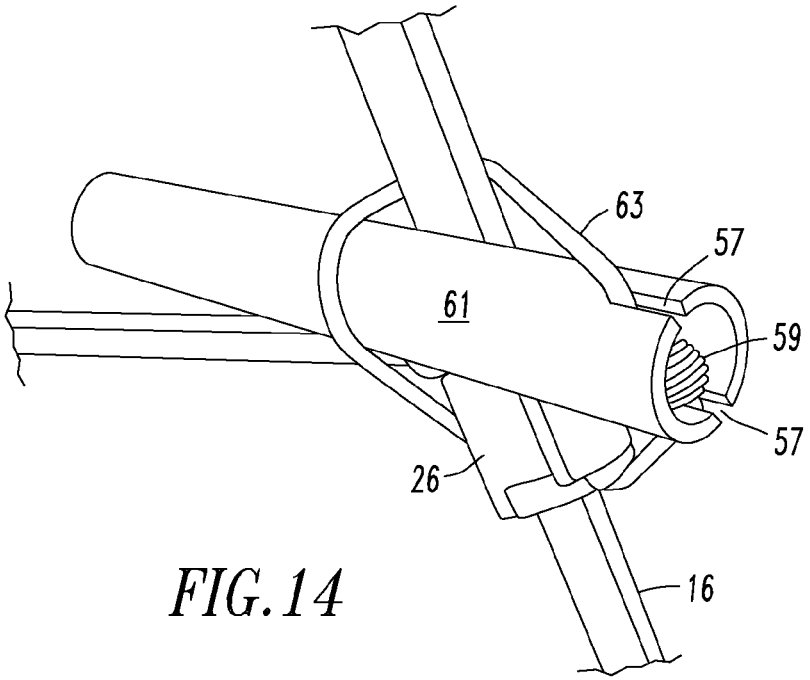
FIG. 14 is a side perspective view of an alternative lower portion of a shoulder stock support for a rifle rest of FIG. 1 being used in conjunction with a tripod.

Referring to FIG. 14, an alternative horizontal support 61 is illustrated. The horizontal support 61 rests against the leg braces 26, 28 of the tripod legs 16, 18 in the same manner as the horizontal support 60 described above. However, the horizontal support 61 defines a pair of substantially axially oriented slots 57 within each end. The illustrated elastomeric cords 63 do not utilize hooks. One end of each of the elastomeric cords 63 is fixed within a slot 57. The remainder of each elastomeric cord 63 extends around the horizontal support 61, tripod leg 16, and finally through the slot 57, with an enlarged diameter end 59 holding the elastomeric cord 63 in place within the slot 57.

Figure 4:
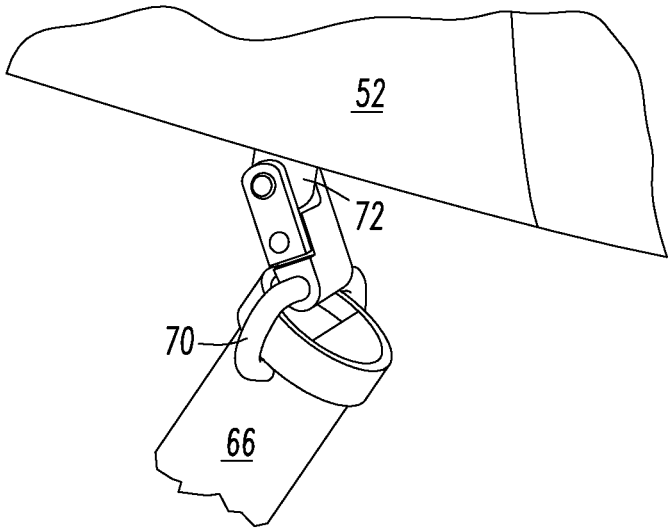
FIG. 4 is a side perspective view of a shoulder stock support secured to a detachable sling swivel mounted on a shoulder stock of a rifle.
Figure 9:
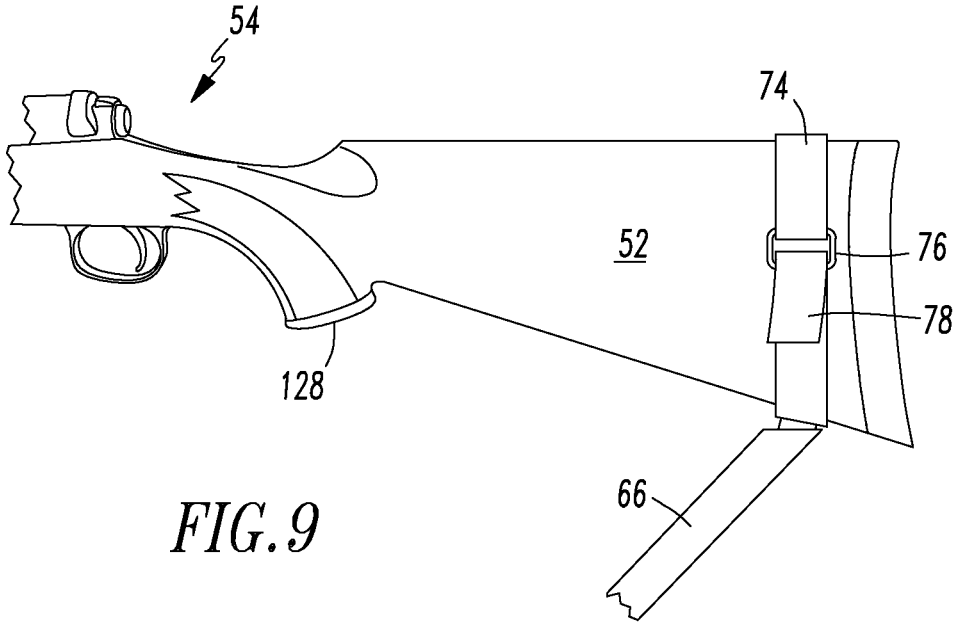
FIG. 9 is a side perspective view of an alternative shoulder stock support for the rifle rest of FIG. 1.

The upper stock support assembly 58 includes a shoulder stock support 66 extending between the shoulder stock 52 and the lower stock support assembly 56. In the illustrated example, the shoulder stock support 66 is connected to the center of the horizontal support 60 by a resilient connection, such as the spring 68. The upper end of the shoulder stock support 66 is structured to fasten to the shoulder stock 52. In the example of FIGS. 1 and 4, a presently available detachable sling swivel 70 is permanently secured to the upper end of the shoulder stock support 66, so that the detachable sling swivel 70 may be secured to or removed from a conventional detachable sling swivel base 72 in a manner well known to those skilled in the art. Alternatively, in the example of FIG. 9, the stock support 66 is connected to a strap 74 that may be secured around the shoulder stock 52 of the rifle 54. The illustrated example of the strap 74 includes a buckle attached to one end of the strap 74. Other examples may use hook and loop fasteners to secure the strap 74 around the shoulder stock 52. The opposite end 78 of the strap 74 passes through the buckle 76 to removably secure the strap 74 around the shoulder stock 52. Some examples of the shoulder stock support 66 are adjustable in length. In the illustrated example, the shoulder stock support 66 includes a hollow lower member 67 that is structured receive the lower end of the upper member 69 therein. A pair of slots 71 are defined in the upper end of the lower member 67, permitting the walls of the upper end to be squeezed together. A clamp 73 is provided for this purpose, thereby securing the upper member 69 in the correct position with respect to the lower member 67 to maintain the appropriate length for the stock support 66.

Figure 15:
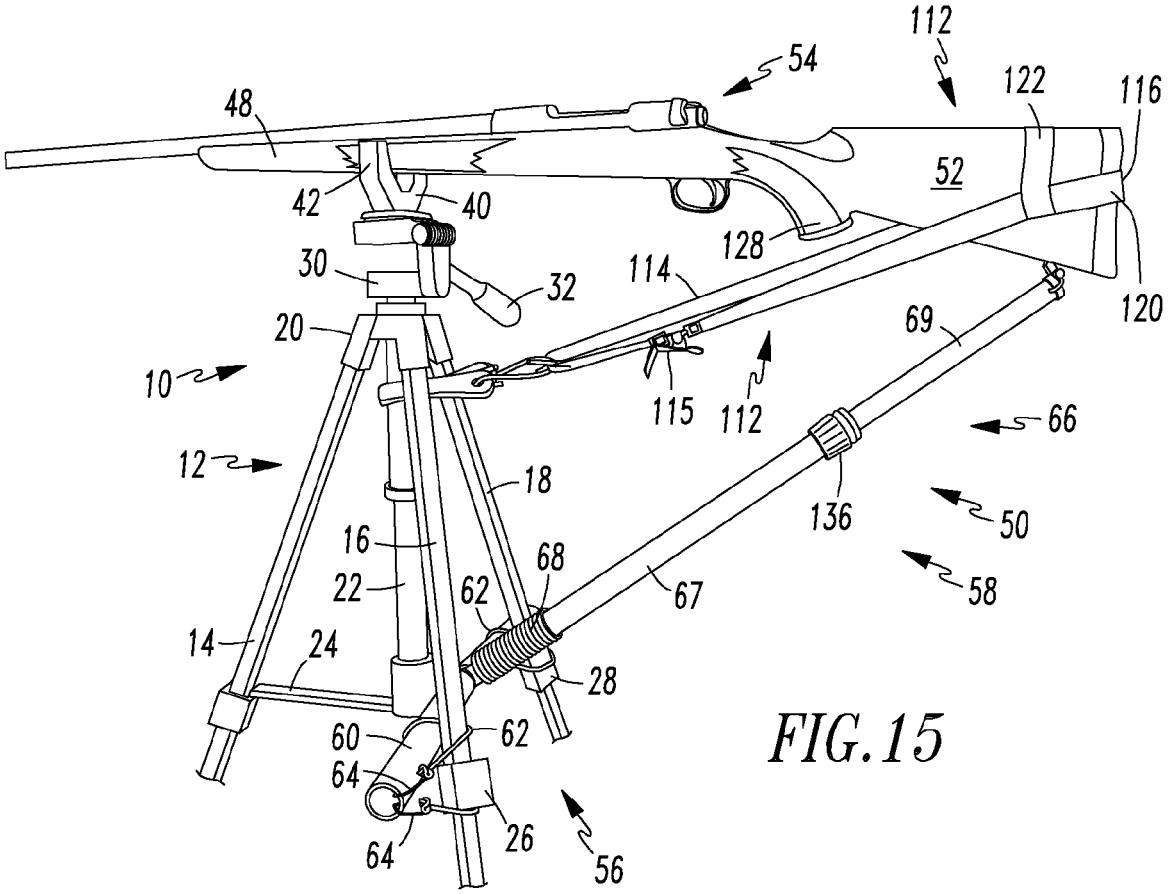
FIG. 15 is an environmental side perspective view of a rifle rest of FIG. 6, having an alternative shoulder stock support.

Referring briefly to FIG. 15, and alternative shoulder stock support 130 is illustrated. The shoulder stock support 130 includes an upper member 132 and a lower member 134 that are secured by a rotating clamp 136. One of either the upper member 132 or the lower member 134 sits inside the other of the upper member 132 or the lower member 134. Twisting the rotating clamp 136 in one direction permits the upper member 132 and lower member 134 to telescope with respect to each other. Twisting the rotating clamp 136 in the opposite direction secures the upper member 132 and lower member 134 relative to each other. Rotating clamps are known to those skilled in the art, and therefore not described in greater detail.

Figure 10:
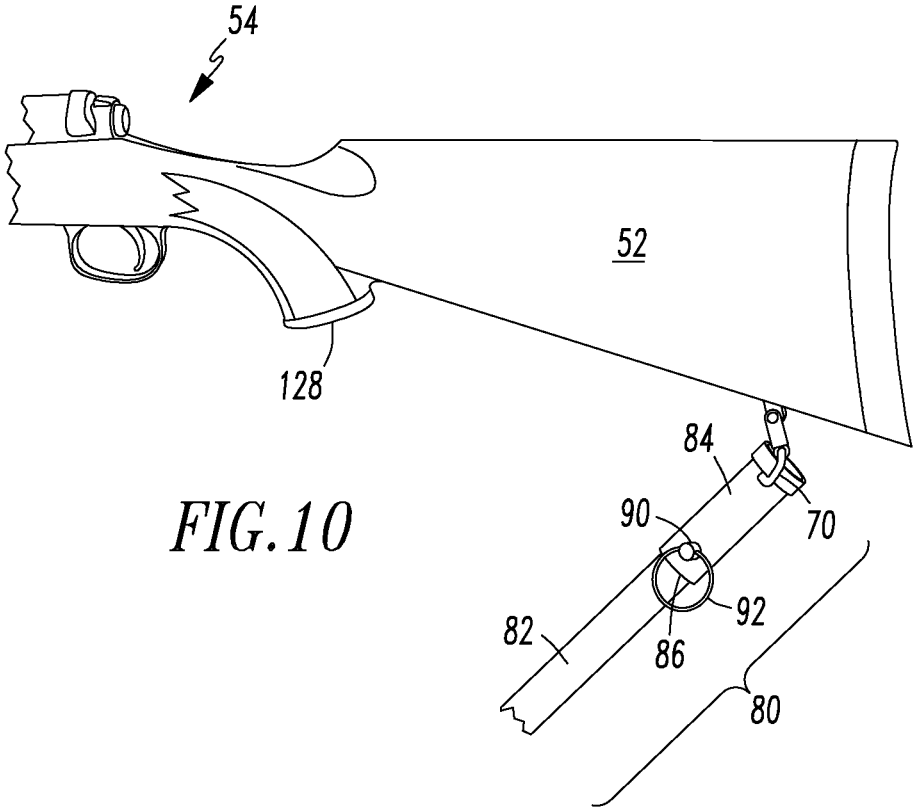
FIG. 10 is a side perspective view of another alternative shoulder stock support for the rifle rest of FIG. 1.
Figure 11:
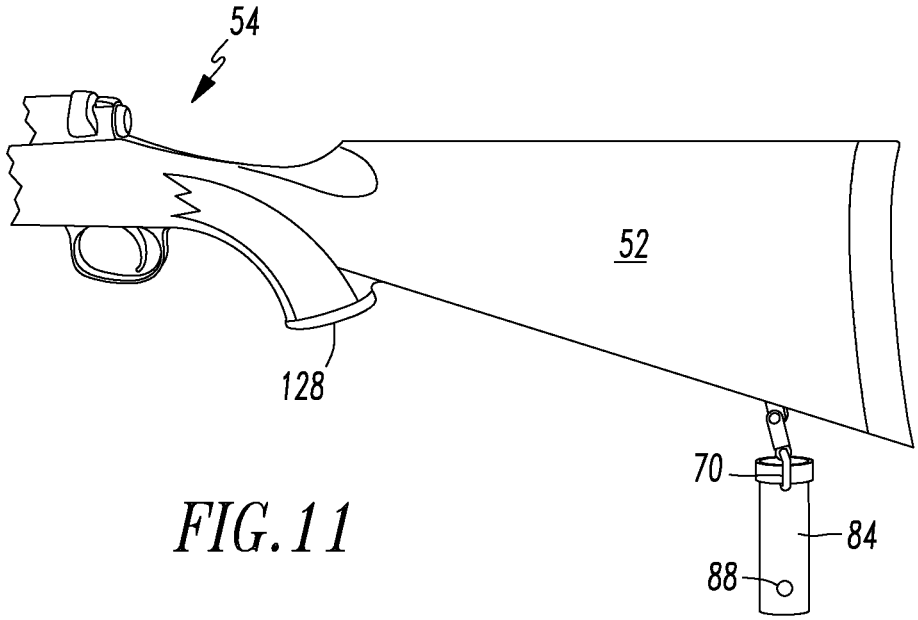
FIG. 11 is a side perspective view of the shoulder stock support of FIG. 10, showing a portion of the shoulder stock support detached from the remainder of the shoulder stock support.

Another shoulder stock support 80 is shown in FIGS. 10-11. The shoulder stock support 80 is similar to the shoulder stock support 66, and may be adjustable in length in the same manner as the shoulder stock support 66. Shoulder stock support 80 includes an elongated body 82 with a removably secured end piece 84 attached to its top end 86. In the illustrated example, the end piece 84 is hollow, and is structured to receive the top end 86 of the body 82. A hole 88 is defined within the end piece 86, with a corresponding hole being defined within the body 82. A pin 90 may pass through the hole 88 as well as the hole defined within the body 82, securing the body 82 to the end piece 84. A ring 92, or other gripping structure, is provided on the pin 90, permitting the pin 90 to be quickly withdrawn, separating the end piece 84 from the body 82, as shown in FIG. 11, and permitting the rifle 54 to be used separately from the rifle rest 10. Although the illustrated example of the end piece 84 is secured to the detachable sling swivel 70, the end piece 84 could also be secured to the strap 74.

Figure 12:
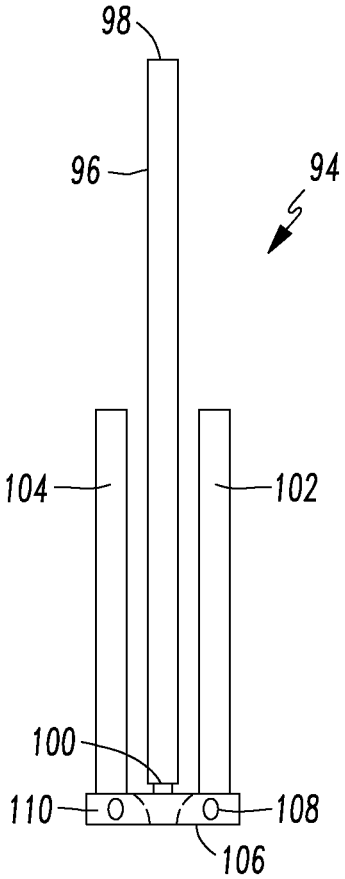
FIG. 12 is a back elevational view of yet another alternative shoulder stock support for the rifle rest of FIG. 1.
Figure 13:
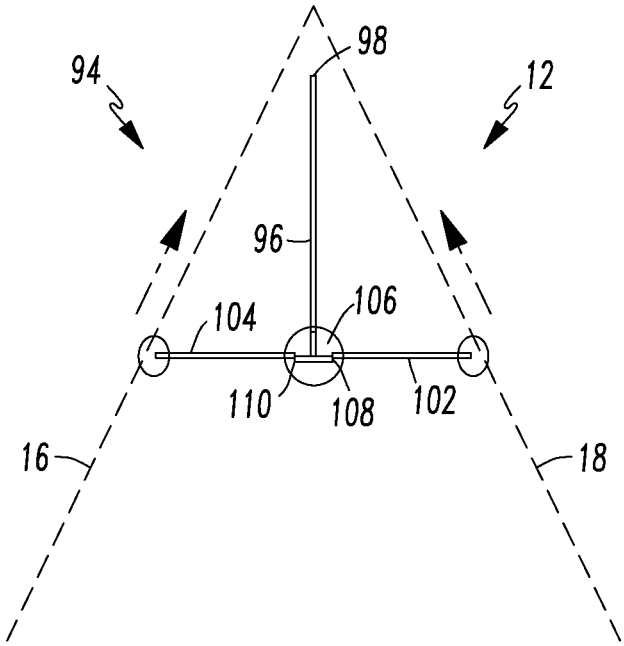
FIG. 13 is a back elevational view of the shoulder stock support of FIG. 12, being used in conjunction with a tripod.

Yet another example of the shoulder stock support assembly 94 is illustrated in FIGS. 12-13. The shoulder stock support assembly 94 includes a shoulder stock support 96 having an upper end 98 and lower end 100. The upper end 98 may be connected to a shoulder stock 52 utilizing any of the methods described above. The lower end 100 is hingedly connected to a pair of horizontal supports 102, 104. In the illustrated example, a bracket 106 having the approximate configuration of an upside down T is secured to the lower end 100 of the shoulder stock support 96. The horizontal supports 102, 104 are connected to the bracket 106 by hinges 108, 110, respectively. The connection between the lower end 100 and bracket 106 may in some examples be a resilient connection including, for example, a spring similar to the spring 68 described above. The horizontal supports 102, 104 are each structured to be secured to one of the three legs 14, 16, 18 of a tripod 12. The method of securing the supports 102, 104 to the legs 14, 16, or 18 of the tripod 12 may include the elastomeric cords 62 as described above, or alternatively may include any clamping mechanism known to those skilled in the art. Some examples may include a clamping mechanism that permits the horizontal supports 102, 104 to slide with respect to the tripod legs 14, 16, 18 as the tripod 12 is collapsed.

Referring to FIG. 13, the shoulder stock support assembly 94 is particularly advantageous if it is desired to leave the shoulder stock assembly 94 attached to the tripod 12 when folding the tripod 12. The hinges 108, 110 permit the horizontal supports 102, 104 to fold inward toward the stock support 96 when the legs 14, 16, or 18 of the tripod 12 are folded, allowing the tripod 12 and stock support 96 to be transported as a single, compact unit. Some examples of the shoulder stock support assembly 94 may be rigidly fastened to the tripod 12.

Figure 6:
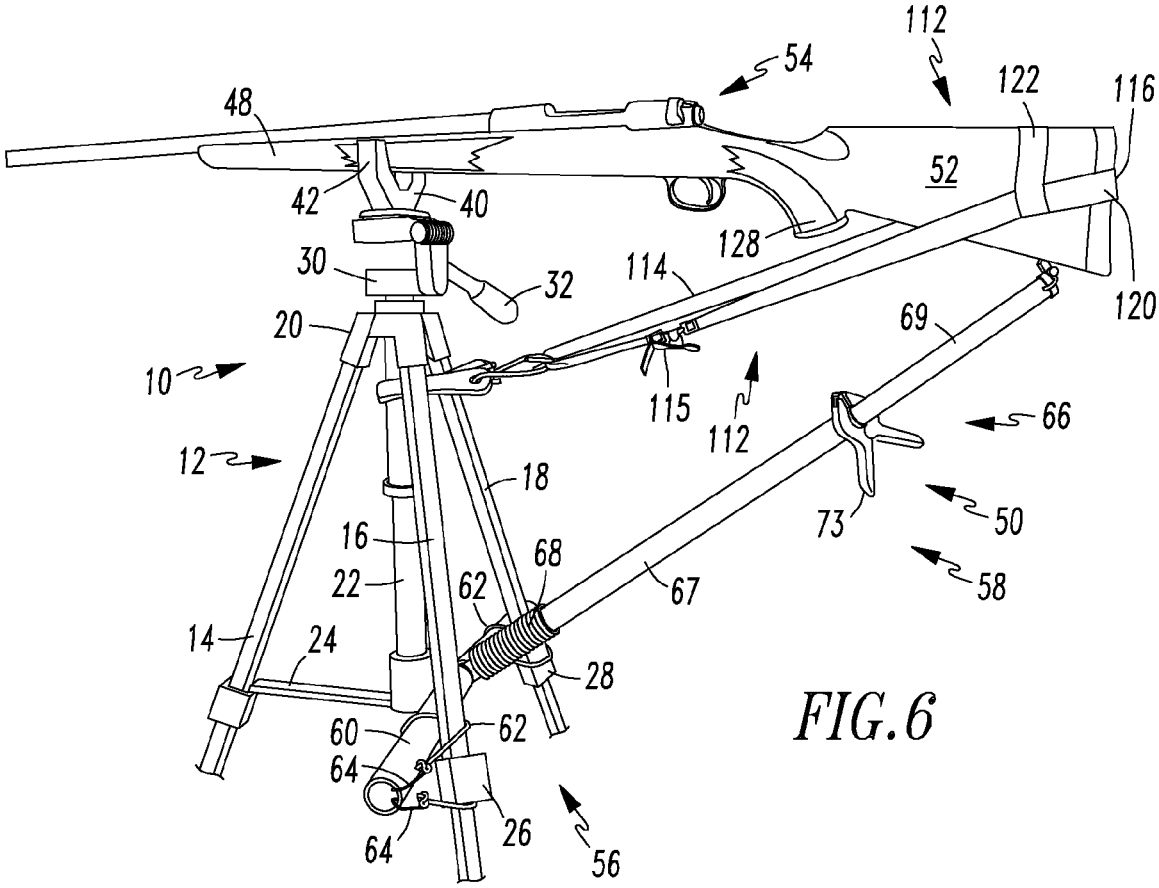
FIG. 6 is an environmental side perspective view of a rifle rest of FIG. 1 having a fore end support of FIG. 2 and a recoil reducer.
Figure 7:
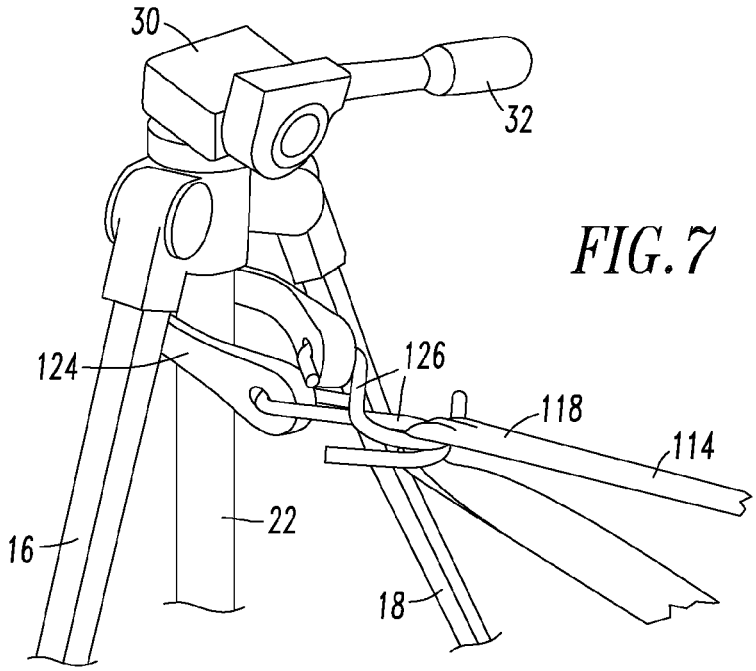
FIG. 7 is a side perspective view of the recoil reducer of FIG. 6 shown in conjunction with a tripod.
Figure 8:
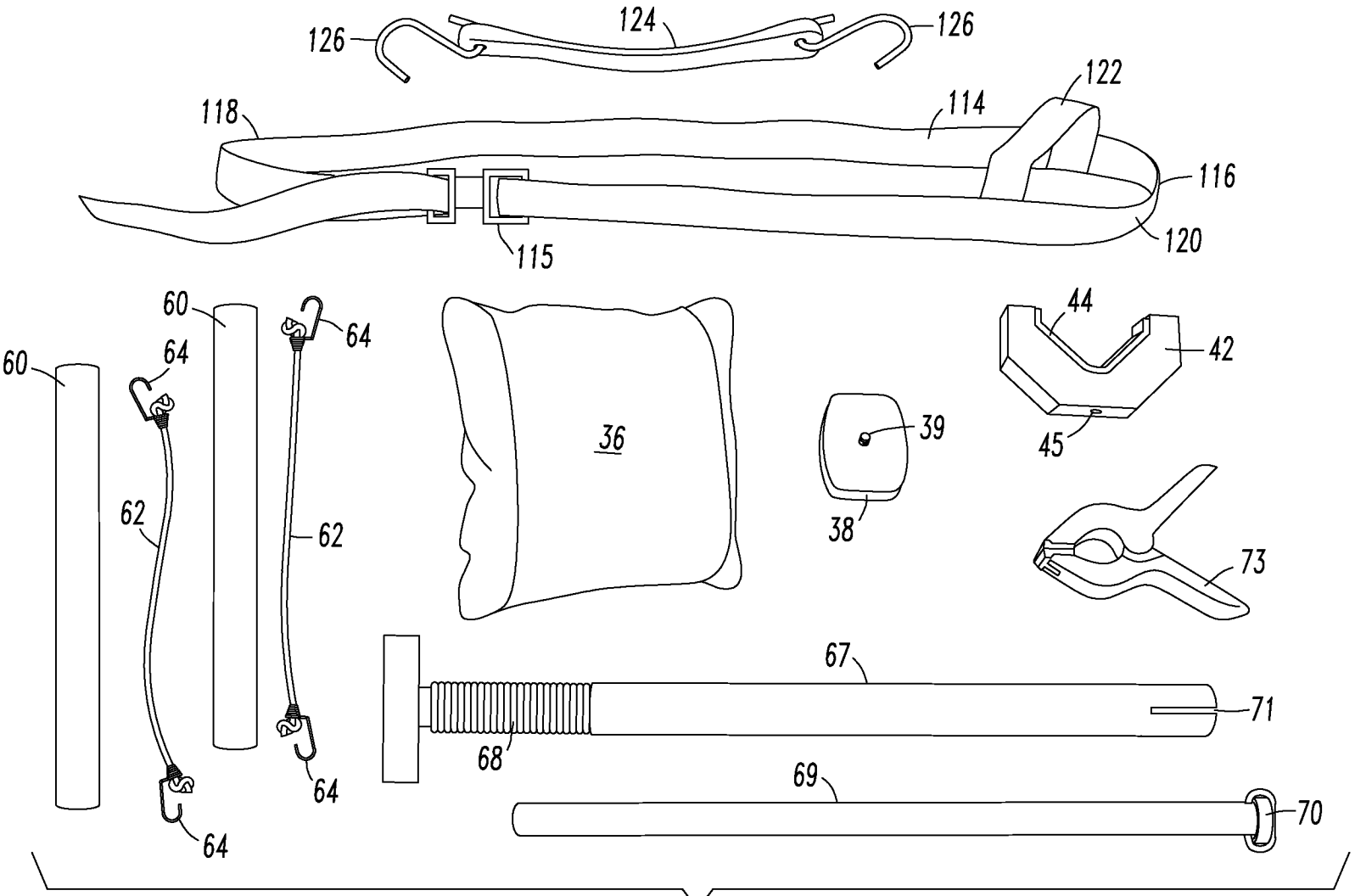
FIG. 8 is a top plan view of the components of a rifle rest of FIG. 6, showing the components disassembled.

Referring to FIGS. 6-8, a recoil reduction assembly 112 is illustrated. The recoil reduction assembly 112 includes a strap 114 that is structured to be attached the rifle 54. In the illustrated example, the strap 114 is structured to be secured around the shoulder stock 52, and includes a buckle mechanism 115 for adjusting the length of the strap 114 in a conventional manner that is known to those skilled in the art. The illustrated example of the strap 114 includes a shoulder stock engaging end 116 and a forward end 118. The shoulder stock engaging and 116 includes a rear portion 120 that is structured to pass around the rear of the shoulder stock 52, and a top portion 122 that is structured to pass over the top of the shoulder stock 52. An elastomeric band 124 is secured around a portion of the tripod 12, and in the illustrated example passes around the central pole 22. The elastomeric band 124 is secured to the forward end 118 of the strap 114, in the illustrated example by a pair of hooks 126.

In use, either the fore end support 34 or the fore end support 40 is attached to the mount 30 of the tripod 12. The horizontal supports 60 or the horizontal supports 102, 104 are secured to two of the three tripod legs 14, 16, 18. The shoulder stock support 66, 96 is secured to the shoulder stock 52 of the rifle 54. The fore end 48 of the rifle 54 is placed on the fore end support 34, 40. If desired, the elastomeric band 124 is positioned around the central pole 22 of the tripod 12, and secured to the forward end 118 of the strap 114. The shoulder stock engaging end 116 of the strap 114 is placed around the shoulder stock 52 of the rifle. The shoulder stock support 66, 96 may then be adjusted in length to place the rifle 54 in the appropriate position. When the rifle 54 is positioned on the rifle rest 10 in this manner, with or without the recoil reduction assembly 112, the rifle 54 is completely supported by the rifle rest 10, without any need to be held by the shooter.

When a shot is to be taken, the shooter may pivot the mount 30 with respect to the central pole 22 of the tripod 12 in order to pivot the rifle 54 horizontally. The spring 68 permits the rifle 54 to move horizontally, while returning it to its original position once the rifle 54 is released. If the recoil reduction assembly 112 is utilized, the shooter may hold the shoulder stock's pistol grip portion 128 with the dominant hand, and the tripod 12 with the nondominant hand. When the shot is fired, the recoil reduction assembly 112 permits the shooter to utilize his/her grip on the tripod 12 to reduce the amount of recoil transmitted to the shooter's shoulder. With both the shooter's shoulder and the nondominant hand, as well as the tripod 112, absorbing the recoil, the level of recoil perceived by the shooter is reduced. The present inventor has found that the use of the rifle rest 10 and recoil reduction assembly 112 permits shooters with sensitivity to recoil to shoot rifles suitable for hunting deer and other large North American game with complete comfort.

When transporting the rifle 54 and rifle rest 10 is desired, the shooter may detach the shoulder stock 52 from the shoulder stock support 66, 96 utilizing any of the methods described above. If the embodiment of FIG. 1 is utilized, the elastomeric cords 62 are detached from the horizontal supports 60. The tripod 12 may then be collapsed. Alternatively, if the rifle rest of FIGS. 12-13 is utilized, then the tripod 12 may be collapsed without detaching the horizontal supports 102, 104 from the tripod 12. In either case, the shooter now has a compact rest that may be easily transported along with the rifle while, for example, walking during a hunt.

The rifle rest therefore provides the maximized support of a tripod while also providing ease of transportation. The rifle rest is capable of completely supporting a rifle, without the assistance of the shooter. Some examples of the rifle rest permit horizontal movement of the rifle, while returning the rifle to its original position. Additionally, some examples of the rifle rest provide for a reduction of felt recoil without simply utilizing additional weight that would have to be carried by the shooter, or mounting the rifle to a stationary structure such as a shooting blind or shooting bench, enabling shooters with recoil sensitivity to shoot relatively large caliber rifles in mobile hunting situations.

A variety of modifications to the above-described embodiments will be apparent to those skilled in the art from this disclosure. For example, other shock absorbing devices, such as springs, bungee cords, etc. could be used instead of the elastomeric band 124 of the recoil reduction assembly 112. Thus, the invention may be embodied in other specific forms without departing from the spirit or essential attributes thereof. The particular embodiments disclosed are meant to be illustrative only and not limiting as to the scope of the invention. The appended claims, rather than to the foregoing specification, should be referenced to indicate the scope of the invention.

What is claimed is:

1. A rifle rest, the rifle having a fore end and a shoulder stock, the rifle rest comprising:
- a fore end support structured to be secured to a top portion of a standard camera tripod; and
- a shoulder stock support assembly, comprising:
  - a lower end portion structured to be secured to two of a tripod's three legs;
  - a shoulder stock support structured to be secured to the shoulder stock; and
  - an elastomeric connection between the lower end portion and the shoulder stock support, the elastomeric connection biasing the shoulder stock support towards a default position;
- whereby a shooter may aim the rifle by moving the rifle against the bias of the elastomeric connection.

2. A rifle rest, the rifle having a fore end and a shoulder stock, the rifle rest comprising:
- a fore end support structured to be secured to a top portion of a tripod; and
- a shoulder stock support assembly, comprising:
  - a lower end portion structured to be secured to two of a tripod's three legs; and
  - a shoulder stock support structured to be secured to the shoulder stock, the shoulder stock support being structured to be secured to a detachable sling swivel that is structured to be releasably secured to the shoulder stock.

3. A rifle rest, the rifle having a fore end and a shoulder stock, the rifle rest comprising:
- a fore end support structured to be secured to a top portion of a tripod; and
- a shoulder stock support assembly, comprising:
  - a lower end portion structured to be secured to two of a tripod's three legs; and
  - a shoulder stock support structured to be secured to the shoulder stock, the shoulder stock support including a strap that is structured to secure the shoulder stock support to the shoulder stock.

4. A rifle rest, the rifle having a fore end and a shoulder stock, the rifle rest comprising:
- a fore end support structured to be secured to a top portion of a tripod; and
- a shoulder stock support assembly, comprising:
  - a lower end portion structured to be secured to two of a tripod's three legs; and
  - a shoulder stock support structured to be secured to the shoulder stock, the shoulder stock support being formed from two shoulder stock support members, one of the shoulder stock support members being releasably secured to the shoulder stock, the other of the shoulder stock support members being secured to the lower end portion of the shoulder stock support assembly, the shoulder stock support members being releasably secured to each other.

5. The rifle rest according to claim 4, wherein one of the shoulder stock support members includes a hollow portion that is structured to receive the other shoulder stock support member therein.

6. The rifle rest according to claim 5:
- wherein each of the shoulder stock support members define corresponding holes therein; and
- further comprising a pin that is structured to fit within both holes defined within the shoulder stock support members, thereby releasably securing the shoulder stock support members together.

7. A rifle rest, the rifle having a fore end and a shoulder stock, the rifle rest comprising:
- a fore end support structured to be secured to a top portion of a tripod; and
- a shoulder stock support assembly, comprising:
  - a lower end portion structured to be secured to two of a tripod's three legs, the lower end portion including a horizontal support that is structured to rest on top of a pair of braces for a pair of legs of a tripod;
  - a shoulder stock support structured to be secured to the shoulder stock; and
  - an elastomeric connection between the lower end portion and the shoulder stock support, the elastomeric connection biasing the shoulder stock support towards a default position;
- whereby a shooter may aim the rifle by moving the rifle against the bias of the elastomeric connection.

8. The rifle rest according to claim 7, wherein the lower end portion further includes a pair of attachments that are structured to secure the lower end portion against a pair of legs of the tripod.

9. A rifle rest, the rifle having a fore end and a shoulder stock, the rifle rest comprising:
- a fore end support structured to be secured to a top portion of a tripod; and
- a shoulder stock support assembly, comprising:
  - a lower end portion structured to be secured to two of a tripod's three legs, the lower end portion including a horizontal support that is structured to rest on top of a pair of braces for a pair of legs of a tripod. the lower end portion further including a pair of elastomeric straps that are structured to secure the lower end portion against a pair of legs of the tripod; and
  - a shoulder stock support structured to be secured to the shoulder stock.

10. A rifle rest, the rifle having a fore end and a shoulder stock, the rifle rest comprising:
- a fore end support structured to be secured to a top portion of a tripod; and
- a shoulder stock support assembly, comprising:
  - a lower end portion structured to be secured to two of a tripod's three legs;

a shoulder stock support structured to be secured to the shoulder stock, and wherein the lower end portion includes a pair of horizontal supports, each of the horizontal supports being hingedly connected to the shoulder stock support, each of the horizontal supports being structured to be releasably secured to one of the legs of a tripod.

11. The rifle rest according to claim 10, wherein the lower end portion is connected to the shoulder stock support by a resilient connection.

12. The rifle rest according to claim 11, wherein the resilient connection is formed by a spring.

13. A rifle rest, the rifle having a fore end and a shoulder stock, the rifle rest comprising:

a fore end support structured to be secured to a top portion of a tripod; and a shoulder stock support assembly, comprising:

a lower end portion including a horizontal support that is structured to attach to a lower portion of a pair of legs of a tripod;

a shoulder stock support structured to be secured to the shoulder stock; and an elastomeric connection between the lower end portion and the shoulder stock support, the elastomeric connection biasing the shoulder stock support towards a default position;

whereby a shooter may aim the rifle by moving the rifle against the bias of the elastomeric connection.

14. A rifle rest, the rifle having a fore end and a shoulder stock, the rifle rest comprising:

a fore end support structured to be secured to a top portion of a tripod; and a shoulder stock support assembly, comprising:

a lower end portion structured to be secured to two of a tripod's three legs;

a shoulder stock support structured to be secured to the shoulder stock; and a resilient connection between the lower end portion and the shoulder stock support; and an elastomeric recoil reducer secured between the rifle and the tripod.

15. The rifle rest according to claim 14, wherein the elastomeric recoil reducer includes a strap assembly secured around the tripod and the shoulder stock, the strap assembly including at least one elastomeric portion.

16. The rifle rest according to claim 14, wherein the elastomeric recoil reducer is detachable from the tripod.

17. A portable rifle rest, the rifle having a fore end and a shoulder stock, the rifle rest comprising:

at least one leg structured to support the fore end of the rifle, the at least one leg being structured to rest on the ground while supporting the fore end of the rifle;

a fore end support structured to be secured to a top portion of the at least one leg;

an elastomeric recoil reducer secured between the rifle and the at least one leg; and the rifle rest being sufficiently compact and lightweight so that it may be carried simultaneously with a rifle by a typical hunter while walking during a hunt;

whereby a hunter may simultaneously carry a rifle and the rifle rest while hunting, and may hold the base with a support hand while shooting, so that a portion of recoil generated by the rifle is absorbed by the shooter's shoulder, and a portion of the recoil is absorbed by the combination of the base and the shooter's support hand.

18. The rifle rest according to claim 17, wherein the elastomeric recoil reducer includes a strap assembly secured around the base and the shoulder stock, the strap assembly including at least one elastomeric portion.

19. The rifle rest according to claim 17, wherein the elastomeric recoil reducer is detachable from the base.

20. A portable rifle rest, the rifle having a fore end and a shoulder stock, the rifle rest comprising:

a tripod having at least one leg structured to support the fore end of the rifle, the tripod being structured to rest on the ground while supporting the fore end of the rifle, the tripod being sufficiently lightweight so that the tripod can be easily carried by a single person;

a fore end support structured to be secured to a top portion of the tripod;

an elastomeric recoil reducer secured between the rifle and the tripod; and the rifle rest being sufficiently compact and lightweight so that it may be carried simultaneously with a rifle by a typical hunter while walking during a hunt;

whereby a hunter may simultaneously carry a rifle and the rifle rest while hunting, and may hold the tripod with a support hand while shooting, so that a portion of recoil generated by the rifle is absorbed by the shooter's shoulder, and a portion of the recoil is absorbed by the combination of the tripod and the shooter's support hand.

* * * * *